US009074331B2

(12) United States Patent
Stender et al.

(10) Patent No.: US 9,074,331 B2
(45) Date of Patent: Jul. 7, 2015

(54) RETRACTABLE CORD QUEUE BARRIER SYSTEM

(71) Applicants: William Stender, Blairstown, NJ (US); Evan Stender, Blairstown, NJ (US)

(72) Inventors: William Stender, Blairstown, NJ (US); Evan Stender, Blairstown, NJ (US)

(73) Assignee: 10-31 Inc., Columbia, NJ (US)

( * ) Notice: Subject to any disclaimer, the term of this patent is extended or adjusted under 35 U.S.C. 154(b) by 136 days.

(21) Appl. No.: 13/792,871

(22) Filed: Mar. 11, 2013

(65) Prior Publication Data

US 2014/0251557 A1 Sep. 11, 2014

(51) Int. Cl.
*E01F 13/02* (2006.01)

(52) U.S. Cl.
CPC ..... *E01F 13/028* (2013.01)

(58) Field of Classification Search
CPC ..... E01F 13/028; E01F 13/022
USPC ..... 256/37–41, 43, 45
See application file for complete search history.

(56) References Cited

U.S. PATENT DOCUMENTS 1,192,060 A * 7/1916 Herzog ..... 256/39
5,117,859 A * 6/1992 Carlson ..... 137/355.25
5,421,530 A 6/1995 Bertagna et al.
5,507,446 A 4/1996 Ditzig
6,143,985 A 11/2000 Knapp et al.
6,338,450 B1 1/2002 Schwendinger
6,969,050 B1 * 11/2005 Loebner ..... 256/1
2002/0063248 A1 * 5/2002 Siegler et al. ..... 256/37
2005/0221963 A1 * 10/2005 Prismall et al. ..... 482/92
2006/0113514 A1 * 6/2006 Prismall ..... 256/1
2008/0156922 A1 * 7/2008 Rabinowitz et al. ..... 242/372
2009/0250673 A1 * 10/2009 Menzel ..... 256/10

FOREIGN PATENT DOCUMENTS

GB 2376247 A * 12/2002 ..... E04H 17/00

* cited by examiner

*Primary Examiner* — Joshua Kennedy
(74) *Attorney, Agent, or Firm* — Thomas J. Germinario

(57) ABSTRACT

A retractable cord queue barrier system uses a spring-biased pulley refraction mechanism acting on a stretchable cord. A constant-force coiled metal spring is used, such that the retraction force on the cord does not increase as the cord is extended—as it would for a helical spring governed by Hooke's Law. The use of a constant-force spring avoids abrupt snap-back of the extended cord when released, as well as the need for excessive pulling force on the cord as it approaches full extension, which tends to cause the stanchion to tip over. Dynamic balance between the contractive force of the stretchable cord and the retractive force of the constant-force spring achieves a taut but not unyielding tension in the interconnecting cords between stanchions.

4 Claims, 6 Drawing Sheets

RETRACTABLE CORD QUEUE BARRIER SYSTEM

BACKGROUND OF THE INVENTION

The present invention relates to the general field of pedestrian barriers, and more particularly to the field of barriers used to control and direct groups of people in public places.

Queue barriers are commonly used to guide and control crowds of people at public events and exhibits. Typical free-standing queue barriers comprise a draped rope or retractable belt stretched between upright tubular stanchions, each mounted on a weighted circular base. For aesthetic reasons, it is often desirable to minimize the diameter of the stanchions and the bulk of the base. The preference for a sleek, unobtrusive look, particularly at artistic exhibits, can dictate the use of slender cords rather than belts between the stanchions.

While spring-loaded spool mechanisms are suitable for use with retractable belt barriers, a spool for the equivalent length of cord would need to be much wider—requiring an unsightly larger stanchion diameter. For retractable cord barriers, proper cord tension is a critical element, since a sagging cord is a visual distraction, while an excessively taut, unyielding cord can pose a tripping or safety hazard.

The present invention addresses these requirements by providing a retraction mechanism in which the cord is helically wound around one or more pairs of opposing pulleys. When the cord is extended, one set of pulleys in each pair remains fixed, while the other slides toward it against the resistance of a constant-force spring. In order to achieve the proper balance of cord and spring tension, the optimal stretch factor of the cord is less than 50%, as compared to 100% stretch cord commonly used in other applications. The optimal stretch factor of the cord is selected to achieve the correct balance between the retraction force of the spring, which is constant, and the extension force of the cord, which increases as the cord stretches. The excessive stiffness of 100% stretch cord translates into a large force that must be exerted to extend the cord. That large extension force must be balanced by an equally large refraction force of the spring, thereby requiring a large spring. But the refraction force of a large spring will cause a stanchion to tip over unless its base is heavily weighted. High spring tension will also cause an extended cord to snap back forcefully and hazardously when released. On the other hand, a cord with minimal or no stretch will be unyielding when taut and can become slack and develop an unsightly sag when extended between stanchions.

There are several U.S. patents directed to spring-biased retraction mechanisms. The systems described in the U.S. patents of Carlson (U.S. Pat. No. 5,117,859), Schwendinger (U.S. Pat. No. 6,338,450) and Bertagna et al. (U.S. Pat. No. 5,421,530) do not employ constant force springs, because there is no need in these applications to maintain a constant tension on the extended hose/cable/cord. Moreover, since the stretch factor of the hose/cable/cord in these applications is negligible, these mechanisms do not need to balance the opposing forces of a spring and a stretched cord, as does the present invention.

While the phone cord rewinder described in the U.S. patent of Ditzig (U.S. Pat. No. 5,507,446) does utilize a constant-force coiled metal spring as the biasing mechanism between the pulleys, it lacks any means of maintaining a constant taut tension on the extended phone cord, which must have a certain amount of slack to be usable.

The U.S. patent of Knapp et al. (U.S. Pat. No. 6,143,985) discloses a cable retracting system for modular components, using a pulley system biased by constant-force coiled metal springs. Unlike the Ditzig mechanism, this apparatus is designed to maintain a low constant force on the extended cable sufficient to prevent dangling and entanglement. But the Knapp system is incapable of providing the "straight line" tension required in a queue barrier and cannot be adapted to handle a stretchable cord.

In short, none of the spring-biased pulley retraction mechanisms disclosed in the prior art address the problem of achieving a constant taut, but yielding, tension in a stretchable cord. Nor can the features of the prior art mechanisms be combined in an obvious way to achieve this functionality of the present invention.

SUMMARY OF THE INVENTION

The present invention is directed to a queue barrier specifically suited for applications, such as museums, which demand an aesthetically pleasing, unobtrusive appearance. In addition to directing the flow of patrons entering an exhibit, these barriers are often used to keep patrons at a safe distance from sensitive art objects. For that reason, barriers that deploy retractable belt or tape restraints between the stanchions are not desirable, because the breadth of the belt or tape interferes with the patrons' view of the protected object. For the same reason, the stanchion itself should have the minimal diameter consistent with its function.

Although a retractable cord has much less visual impact than a belt or tape, it has a greater bulk when wrapped around a spool than does a belt or tape. Since spring-loaded spools are the standard retraction mechanisms in existing queue barriers, the objective of combining a retractable cord with a slender stanchion is the central technical problem which the present invention addresses.

The present invention addresses this technical problem by providing, instead of the standard spring-loaded spool retraction mechanism, a spring-biased pulley retraction mechanism acting on a stretchable cord. A constant-force coiled metal spring is used, such that the retraction force on the cord does not increase as the cord is extended—as it would for a helical spring governed by Hooke's Law. The use of a constant-force spring avoids abrupt snap-back of the extended cord when released, as well as the need for excessive pulling force on the cord as it approaches full extension, which tends to cause the stanchion to tip over.

The present invention achieves a dynamic balance between the constant retraction force of the spring-biased pulley system and the opposing contraction force of the stretched cord as it extends. The elastic cord most commonly used in other applications has a stretch factor of 100%—i.e., it will expand to twice its unstretched length. The contraction force exerted by 100% stretch cord will increase proportionally to its stretch until it reaches full extension. While it's possible to maintain a balance between this contraction force and the retraction force of the spring if the latter force also proportionally increases in accordance with Hooke's Law, the barrier stanchion would tend to tip over at full extension unless its base were heavily weighted to anchor the spring. In combination with a constant-force spring, on the other hand, a balance between the proportionally increasing contraction force of 100% stretch cord and the constant refraction force of the spring cannot be maintained over the entire extension of the cord. Either the spring must be over-sized, in which case the extended cord will be excessively taut, creating a tripping/safety hazard, or the spring must be under-sized, in which case the extended cord will be slack and unsightly and will not retract properly.

By utilizing a cord with a stretch factor of less then 50%, the present invention achieves a dynamic balance between the contraction force of the cord and the constant retraction force of the spring-biased pulley system. As the cord is extended, it initially stretches until it becomes taut, yet yielding if engaged by a patron. As the cord is further extended, its contraction force and the retraction force of spring-biased pulley system remain in balance, allowing the taut but yielding tension of the cord to be maintained without exerting an excessive tipping force on the stanchion.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
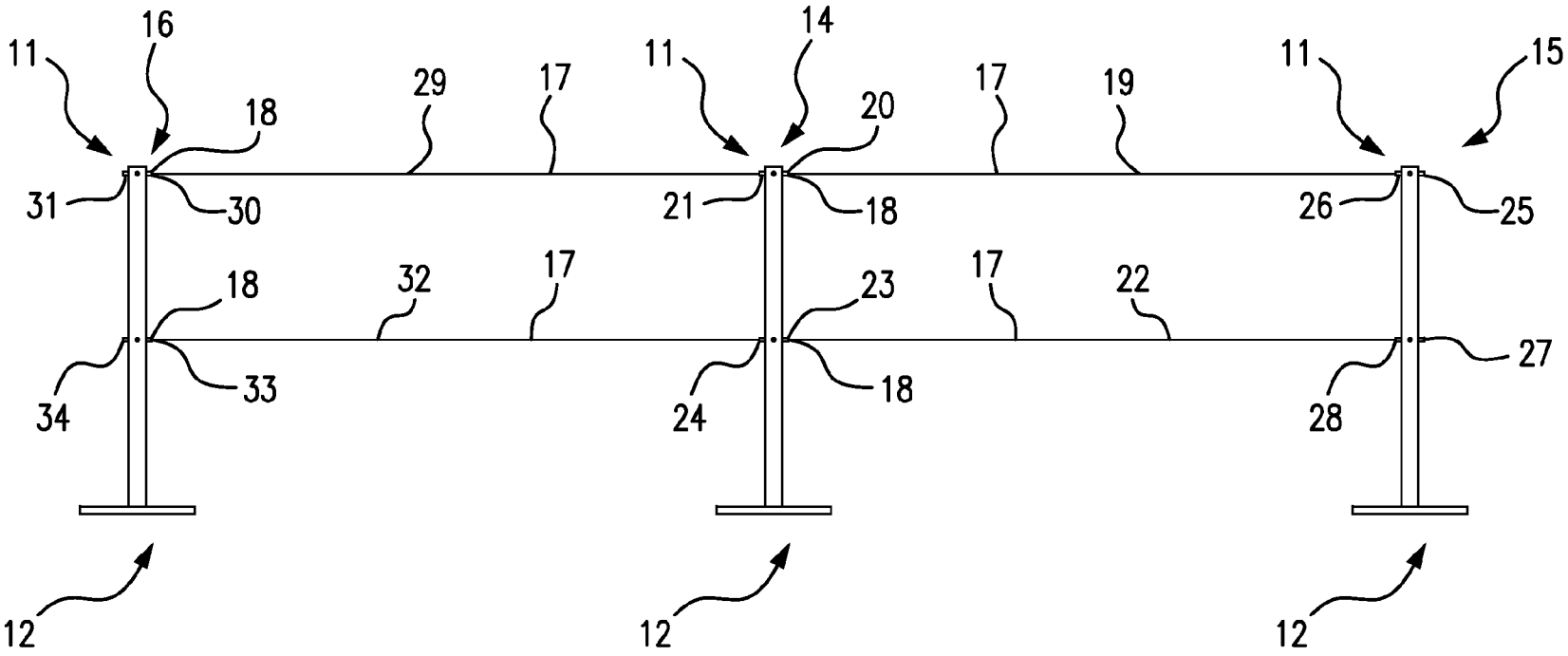
FIG. 1 is a front view of an exemplary queue barrier comprising three (3) interconnected stanchions.
Figures 2A, 2B, 2C:
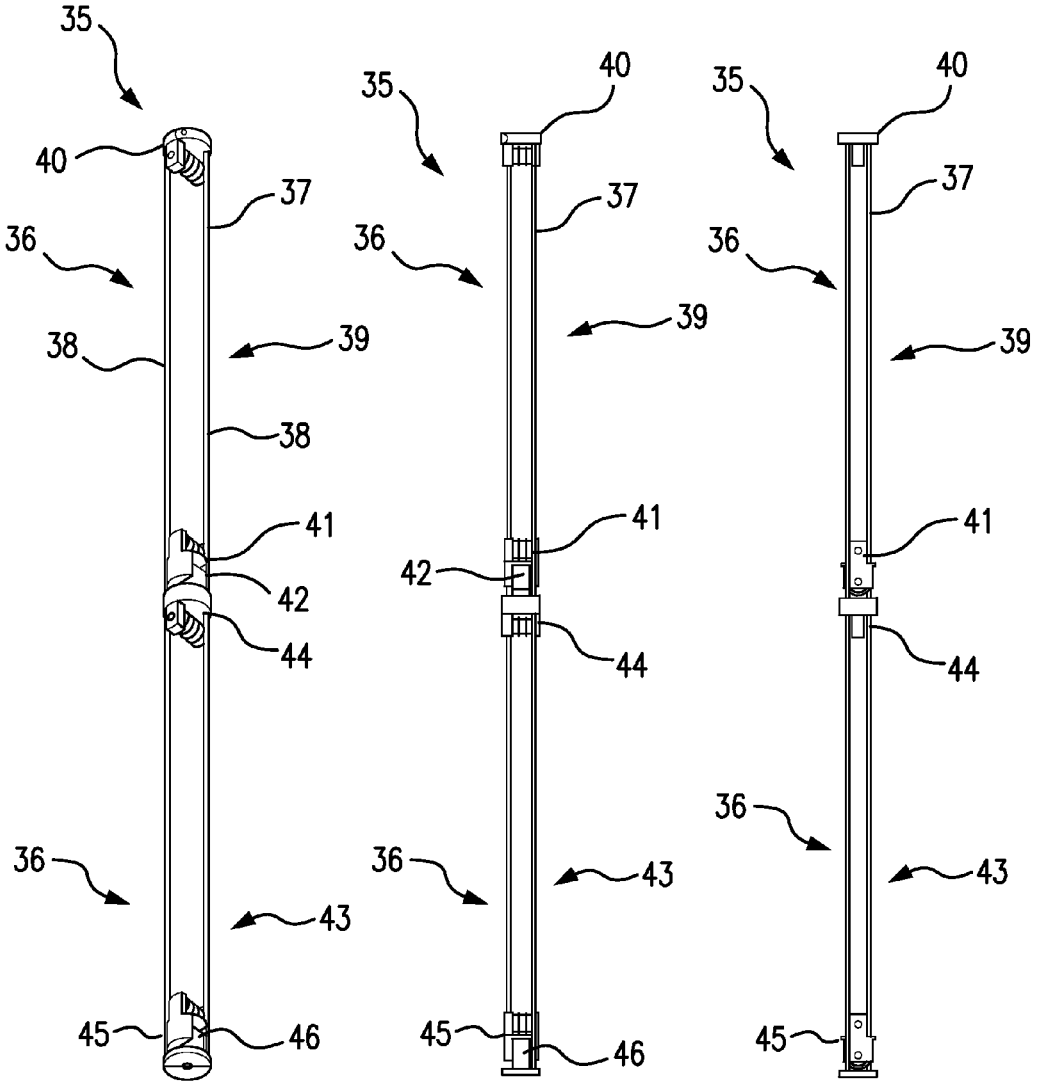
FIG. 2A is a perspective view of a retraction mechanism, comprising two pairs of spring-biased opposing pulleys, according to the preferred embodiment of the present invention.
FIG. 2B is a front view of a refraction mechanism, comprising two pairs of spring-biased opposing pulleys, according to the preferred embodiment of the present invention.
FIG. 2C is a rear view of a retraction mechanism, comprising two pairs of spring-biased opposing pulleys, according to the preferred embodiment of the present invention.
Figure 3:
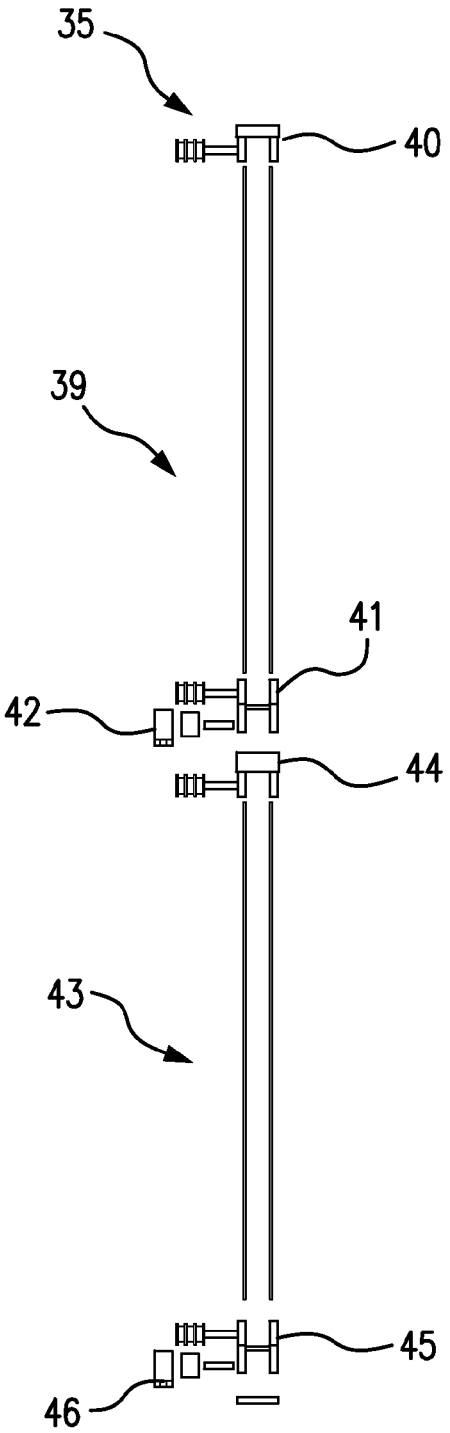
FIG. 3 is an exploded view of a retraction mechanism, comprising two pairs of spring-biased opposing pulleys, according to the preferred embodiment of the present invention.

Referring to FIG. 1, an exemplary queue barrier system 10 according to the present invention comprises three (3) tubular stanchions 11, each supported by a weighted base 12. Alternately, each of the stanchions can be anchored in a floor socket 13, of which FIGS. 7A-7D depict an illustrative example.

In FIG. 1, a first stanchion 14 is releasably connected to a second stanchion 15 by two retractable elastic cords 17, which extend from two cord apertures 18 in the first stanchion 14. A first upper cord 19 extends from a first upper cord aperture 20 of the first stanchion 14 and releasably attaches to a second upper cord connector 26 of the second stanchion 15. A first lower cord 22 extends from a first lower cord aperture 23 of the first stanchion 14 and releasably attaches to a second lower cord connector 28 of the second stanchion 15.

The reason for having both upper and lower cords 17 interconnecting the stanchions 11 is compliance with ADA requirements, with the lower cords serving as an indicator for visually-impaired persons. The upper cords are set at approximate hip-to-waist level for a standing person, while the lower cords are at approximate knee level.

Referring again to FIG. 1, the first stanchion 14 is releasably connected to a third stanchion 16 by two retractable elastic cords 17, which extend from two cord apertures 18 in the third stanchion 16. A third upper cord 29 extends from a third upper cord aperture 30 of the third stanchion 16 and releasably attaches to a first upper cord connector 21 of the first stanchion 14. A third lower cord 32 extends from a third lower cord aperture 33 of the third stanchion 16 and releasably attached to a first lower cord connector 24 of the first stanchion 14.

It is understood that this illustrative three-stanchion barrier system can be further extended. For example, the second stanchion 15 can be further connected to a fourth stanchion (not shown) by extending upper and lower elastic cords (not shown) from a second upper cord aperture 25 and a second lower cord aperture 27 to corresponding upper and lower cord connectors of the fourth stanchions (not shown). Similarly, the third stanchion 16 can be connected to a fifth stanchion (not shown) by extending upper and lower elastic cords (not shown) from the fifth stanchion to the third upper cord connector 31 and the third lower cord connector 34, respectively. In this manner, the queue barrier can be indefinitely extended in either direction according to the desired area to be enclosed.

Although, in the exemplary barrier system 10 depicted in FIG. 1, the stanchions 11 are arranged in a straight line, it is understood that angular connections between the stanchions 11 are also feasible, and that multiple cord connectors can be located on the stanchions 11 at various angles with respect to the cord apertures 18.

FIGS. 2A-2C and FIG. 3 depict an exemplary mechanism 35 within each stanchion 11 which controls the extension and retraction of the elastic cords 17. The depicted embodiment 35 comprises two pairs of opposing spring-biased pulleys 36, which are mounted on a pulley frame 37 consisting of two parallel frame rods 38 anchored to the stanchion 11. An upper pair of pulleys 39 comprises an upper fixed pulley 40, which is fixedly attached to the upper end of the pulley frame 37, and an upper movable pulley 41, which is slidably attached to the midsection of the pulley frame 37. A constant-force upper coil spring 42 is anchored to the pulley frame 37 immediately below the upper movable pulley 41, with the free end of the coil 42 attached to the upper movable pulley 41 and restraining its movement toward the upper fixed pulley 40.

Similarly, a lower pair of pulleys 43 comprises a lower fixed pulley 44, which is fixedly attached to the midsection of the pulley frame 37 below the upper coil spring 42, and a lower movable pulley 45, which is slidably attached to the lower end of the pulley frame 37. Optionally, the upper coil spring 42 can be anchored to the pulley frame 37 by the same structure that attaches to the lower fixed pulley 44 to the midsection of the pulley frame 37. A constant-force lower coil spring 46 is anchored to the pulley frame 37 immediately below the lower movable pulley 45, with the free end of the coil 46 attached to the lower movable pulley 45 and restraining its movement toward the lower fixed pulley 41.

Figure 4:
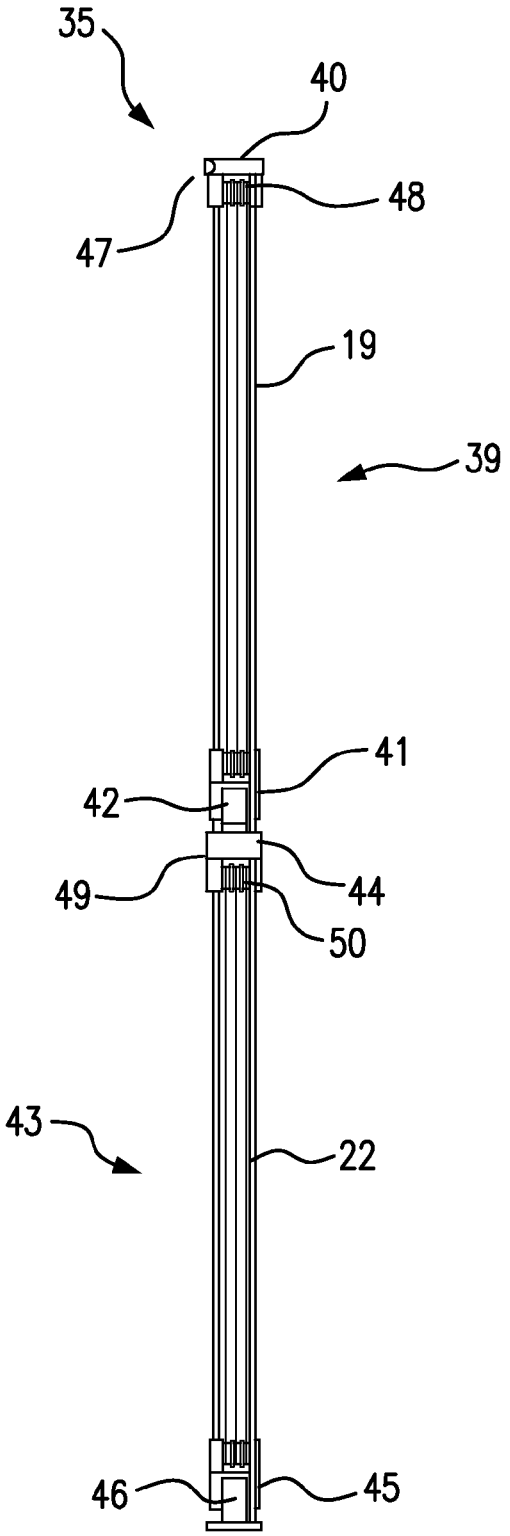
FIG. 4 is a front view of a retraction mechanism, comprising two pairs of spring-biased opposing pulleys, with an elastic cord helically winding around each pair of opposing pulleys, according to the preferred embodiment of the present invention.

Referring now to FIG. 4, the upper cord 19 helically winds around the upper pair of pulleys 39, with its proximal end 47 anchored in the upper fixed pulley 40, and its distal end 48 extending outward from the upper fixed pulley 40 through the upper cord aperture 20 of the stanchion 11. When the distal end 48 of the upper cord 19 is pulled away from the stanchion 11 to interconnect it with an adjoining stanchion (as shown in FIG. 1), the shortening of the length of the upper cord 19 helically winding around the upper pair of pulleys 39 draws the upper movable pulley 41 toward the upper fixed pulley 40 against the constant retractive force of the upper coil spring 42.

As the elastic upper cord 19 is extended, it stretches to its maximum length, which is preferably about 20% greater than its unstretched length. The 20% stretch factor allows the upper coil spring 42 to be moderately sized, so that its retraction force is not so great as to tip the stanchion 11 to which it's anchored or to cause the upper cord to snap back forcefully when released. The size of the upper coil spring 42 is selected so that its constant retractive force balances the contractive force of the upper cord 19 when fully stretched.

Referring again to FIG. 4, the lower cord 22 helically winds around the lower pair of pulleys 43, with its proximal end 49 anchored in the lower fixed pulley 44, and its distal end 50 extending outward from the lower fixed pulley 44 through the lower cord aperture 23 of the stanchion 11. When the distal end 50 of the lower cord 22 is pulley away from the stanchion 11 to interconnect it with an adjoining stanchion (as shown in FIG. 1), the shortcoming of the length of the lower cord 22 helically winding around the lower pair of pulleys 43 draws the lower movable pulley 45 toward the lower fixed pulley 44 against the constant retractive force of the lower coil spring 46.

As the elastic lower cord 22 is extended and stretched to its maximum length, its contractive tension balances the retractive force of the lower coil spring 46 in the same way as described above with reference to the dynamic balance between upper cord 19 and upper coil spring 42.

Figure 5A:
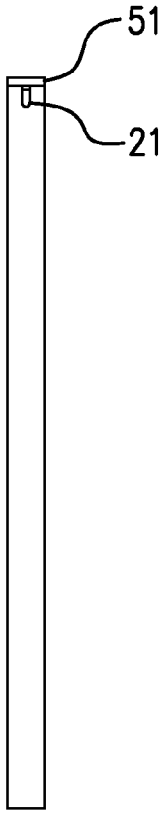
FIG. 5A is a detail view of a spring-loaded cord connector in the closed position.
Figure 5B:
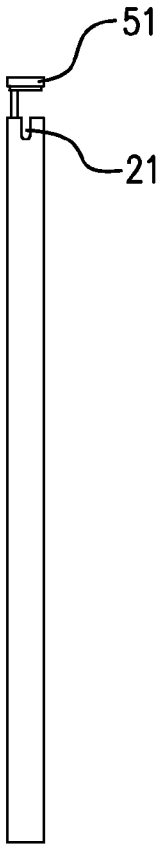
FIG. 5B is a detail view of a spring-loaded cord connector in the unlocked open position.
Figure 5C:
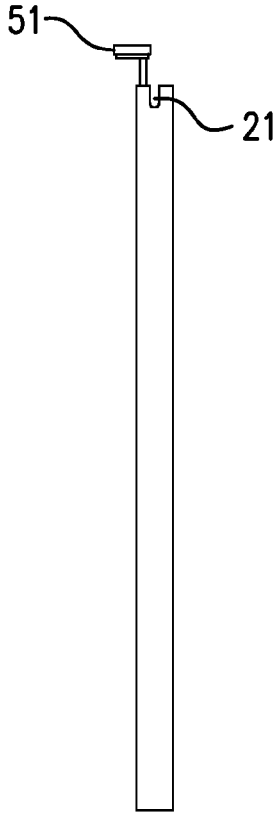
FIG. 5C is a detail view of a spring-loaded cord connector in the locked open position.
Figure 6A:
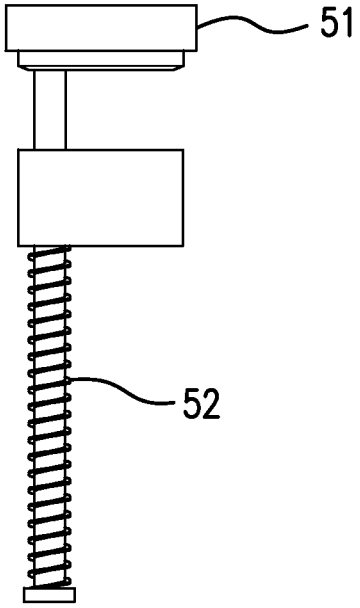
FIG. 6A is a detail view of the closed position of the spring mechanism of the spring-loaded cord connector as depicted in FIG. 5A.
Figure 6B:
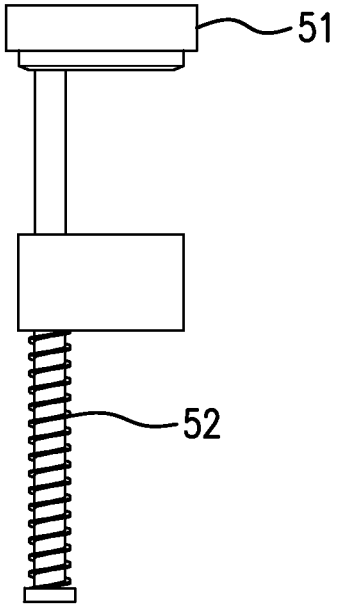
FIG. 6B is a detail view of the unlocked open position of the spring mechanism of the spring-loaded cord connector as depicted in FIG. 5B.
Figure 6C:
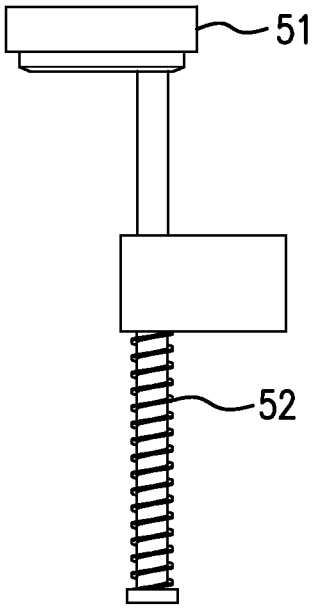
FIG. 6C is a detail view of the locked open position of the spring mechanism of the spring-loaded cord connector as depicted in FIG. 5C.
Figure 7A:
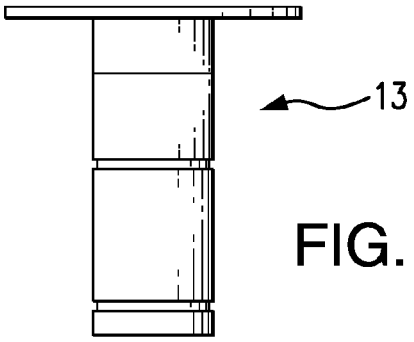
FIGS. 7A-7D are views of an exemplary floor socket for the support of one of the stanchions of the present invention.
Figure 7B:
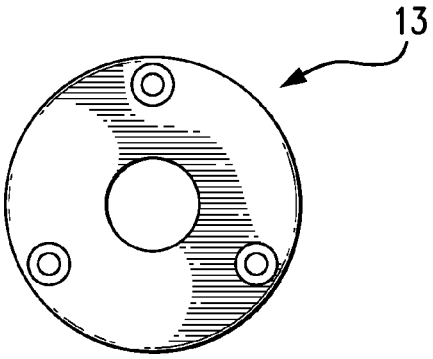
Figure 7C:
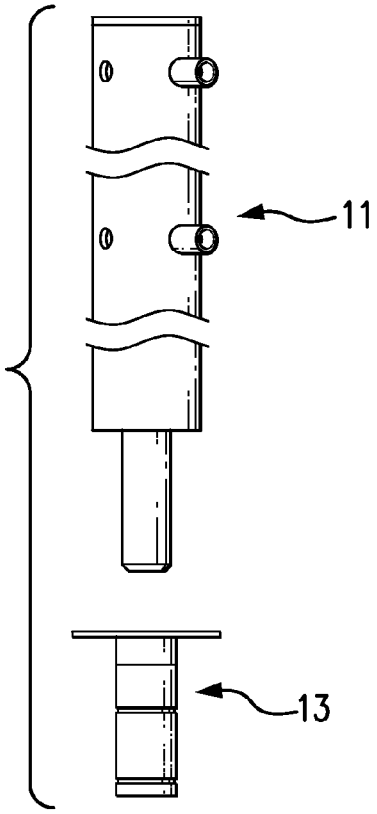
Figure 7D:
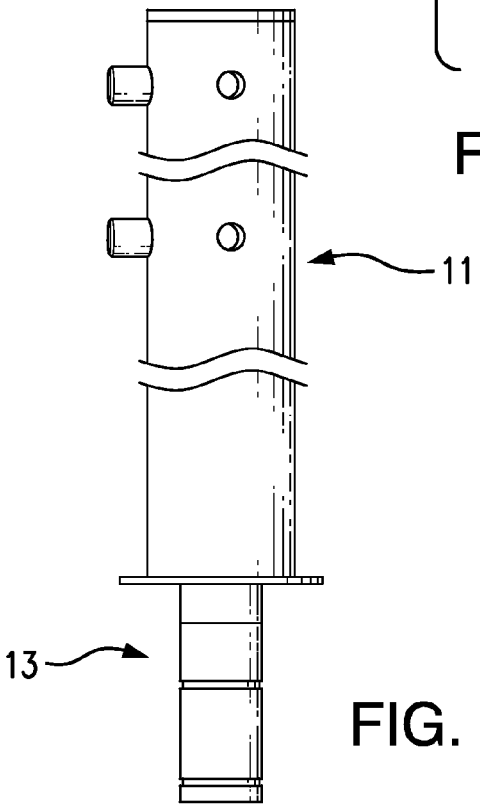

FIGS. 5A-5C and FIGS. 6A-6C depict an optional configuration for accessing the upper cord connector 21 of the stanchions 11. The top of the stanchion 11 is configured with a spring-loaded liftable access cap 51, through which the upper cord connector 21 can be accessed with a connecting cord from an adjoining stanchion. As shown in FIGS. 5A and 6A, the access cap 51 is retained in the closed position by a spring mechanism 52—in this example a helical spring. As the cap 51 is lifted into the open position, depicted in FIG. 5B, the spring 52 is compressed, as shown in FIG. 6B. When the cap 51 is swiveled outward, as shown in FIG. 5C, it locks in the open position against the restoring force of the spring 52, as depicted in FIG. 6C. With the access cap 51 locked in the open position, the upper cord connector 21 is accessible to a connecting cord extending from another stanchion, as shown in FIG. 5C. Once the connecting cord is in place, the access cap 51 is swiveled inward again, as shown in FIG. 5B, and the spring 52 is able to retract (FIG. 6B) and restore the cap 51 to the closed position depicted in FIGS. 5A and 6A.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A queue barrier system comprising:

multiple upright tubular stanchions, each stanchion supported by a weighted base or a floor socket, wherein each stanchion has one or more cord apertures and one or more cord connectors;

within each of the stanchions, one or more cord retraction mechanisms, each cord retraction mechanism comprising one or more pairs of opposing pulleys, wherein each pair of opposing pulleys comprises a fixed pulley and a movable pulley and a constant-force spring, wherein the spring resists movement of each movable pulley toward the opposing fixed pulley with a constant retractive force;

within and extendable from each of the stanchions, one or more elastic cords, each cord having a fixed proximal end within the stanchion and an extendable distal end projecting through one of the cord apertures of the stanchion, wherein each cord helically winds around one of the pairs of opposing pulleys, with the proximal end of the cord attached to the fixed pulley, such that, when the distal end of the cord is pulled, the movable pulley draws closer to the fixed pulley against the retractive force of the spring, and the cord can be extended outward from the stanchion wherein each cord has a maximum extended length and a minimum unextended length, and wherein the difference between the maximum extended length and the minimum unextended length constitutes a stretch length, and wherein the ratio of the stretch length to the minimum unextended length constitutes a stretch factor, and wherein the stretch factor of each cord is greater than ten percent (10%) and less than fifty percent (50%), such that, when each cord is at the maximum extended length, the cord exerts a balancing contractive force opposite in direction to the retractive force of the spring, so as to maintain a taut, but not rigidly unyielding, tension on the cord; and wherein a first stanchion is releasably connectable to a second stanchion and a third stanchion by extending the cord(s) of the first stanchion to engage the cord connector(s) of the second stanchion and extending the cord(s) of the third stanchion to engage the cord connector(s) of the first stanchion, such that the first, second and third stanchions form a queue barrier, which can be further extended by consecutive connections of fourth, fifth and subsequent stanchions.

2. The queue barrier system of claim 1, wherein the stretch factor of each cord is twenty percent (20%).

3. The queue barrier system of claim 2, wherein the pairs of opposing pulleys comprise an upper pair of pulleys and a lower pair of pulleys, and wherein the elastic cords comprise an upper cord and a lower cord, and wherein the distal end of the upper cord projects through and is extendable through an upper cord aperture of the stanchion, and the distal end of the lower cord projects through and is extendable through a lower cord aperture in the stanchion, and wherein the cord connectors comprise one or more upper cord connectors and one or more lower cord connectors.

4. The queue barrier system of claim 3, wherein the upper cord connector(s) further comprise a liftable access cap at the top of the stanchion, wherein the access cap is urged into a closed position by a spring mechanism, and wherein the access cap can be lifted to an open position, in which open position the upper cord connector(s) are accessible to the insertion of an interconnecting cord from another stanchion, and wherein the access cap can be rotated so as to be locked in the open position.

* * * * *

UNITED STATES PATENT AND TRADEMARK OFFICE

CERTIFICATE OF CORRECTION

PATENT NO. : 9,074,331 B2
APPLICATION NO. : 13/792871
DATED : July 7, 2015
INVENTOR(S) : Stender et al.

It is certified that error appears in the above-identified patent and that said Letters Patent is hereby corrected as shown below:

On the title page item [57], delete “refraction” and insert -- retraction --.

In the Specification

Column 1, lines 40 and 41, “refraction” should read “retraction”.

Column 3, line 30, “refraction” should read “retraction”.

Signed and Sealed this
Third Day of November, 2015

Michelle K. Lee

Michelle K. Lee
*Director of the United States Patent and Trademark Office*